US009199245B1

(12) United States Patent
Kikutani et al.

(10) Patent No.: US 9,199,245 B1
(45) Date of Patent: Dec. 1, 2015

(54) WATER SUPPLY LAUNDER OF TABLE GRAVITY CONCENTRATOR

(71) Applicant: SUMITOMO METAL MINING CO., LTD., Tokyo (JP)

(72) Inventors: Hideki Kikutani, Tokyo (JP); Daishi Ochi, Tokyo (JP); Takeshi Nakamura, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 14/500,361

(22) Filed: Sep. 29, 2014

(51) Int. Cl.

| | |
|---|---|
| ***B07B 9/00*** | (2006.01) |
| ***B03B 5/04*** | (2006.01) |
| ***B03B 11/00*** | (2006.01) |
| *C22B 59/00* | (2006.01) |
| *C22B 3/00* | (2006.01) |
| *C22B 3/02* | (2006.01) |

(52) U.S. Cl.
CPC . *B03B 5/04* (2013.01); *B03B 11/00* (2013.01); *C22B 3/00* (2013.01); *C22B 3/02* (2013.01); *C22B 59/00* (2013.01)

(58) Field of Classification Search
CPC ..... C22B 3/02; C22B 7/04; C22B 3/00; C22B 59/00
See application file for complete search history.

(56) References Cited

U.S. PATENT DOCUMENTS

| | | | | |
|---|---|---|---|---|
| 5,720,236 | A * | 2/1998 | Carrano et al. | 119/14.46 |
| 6,818,042 | B2 | 11/2004 | Peacocke et al. | |
| 2014/0151306 | A1* | 6/2014 | Downey et al. | 210/702 |

FOREIGN PATENT DOCUMENTS

| | | | |
|---|---|---|---|
| JP | 2012-139675 | A | 7/2012 |

* cited by examiner

*Primary Examiner* — Howard Sanders
(74) *Attorney, Agent, or Firm* — Osha Liang LLP

(57) ABSTRACT

A water supply launder reducing imbalance of the flow amounts of the ore slurry and the additive water on the upper surface of the shaking table, and producing flow throughout the upper surface of the shaking table.

The water supply launder included in a table gravity concentrator 1 to supply water to a table 2 of the table gravity concentrator 1 includes a launder body 20 which receives water supplied from a water supply unit 23 to an upper surface 21*a* of the launder body 20, and supplies the water to the table 2 of the table gravity concentrator 1, and a distribution member 30 which is attached to a lower surface 21*b* of the launder body 20, and contacts water dropping from the upper surface 21*a* of the launder body 20 and flowing to the table 2 of the table gravity concentrator 1 to distribute the water.

8 Claims, 11 Drawing Sheets

WATER SUPPLY LAUNDER OF TABLE GRAVITY CONCENTRATOR

BACKGROUND

1. Technical Field

The present invention relates to a water supply launder included in a table gravity concentrator for recovering concentrates from ores. This water supply launder supplies water to a table of the table gravity concentrator.

2. Related Art

There are various concentration methods adopted for recovering concentrates from ores. For example, a gold ore concentration method currently employed crushes gold ores, and pulverizes the gold ores into particles having an appropriate particle size. The recovered concentrate particles are suspended in cyanide solution to leach gold. This method is called a cyanide process, by which process gold is separated from gangue minerals or sulfide minerals and concentrated. Another method currently employed initially separates gold concentrates from gangue minerals or sulfide minerals by gravity concentration and flotation, and then further separates and concentrates gold by using the cyanide process.

According to the cyanide process performed in these methods, entire gold contained in coarse ore particles is difficult to be dissolved. In this case, gold recovery is insufficiently achieved.

For overcoming this drawback, a technology of table gravity concentration (also called flowing film concentration) is proposed as a method for recovering high-grade gold concentrates. This method achieves direct refinement only by performing gravity concentration (for example, see Patent Literature 1). In addition, such a technology is proposed which automates control of a partition plate by combining the foregoing table gravity concentration and an image processing technology (for example, see Patent Literature 2).

FIG. 12 illustrates the principle of the table gravity concentration. This concentration is a method using a shaking table 102 provided with a plurality of riffles 103, and supplies ore slurry from an ore supply launder 104 to the shaking table 102 in the width direction of the shaking table 102 while oscillating the shaking table 102 in the extension direction of the riffles 103 by using an oscillation driving mechanism 111. The ore slurry is produced from a mixture of ores pulverized into ore particles, and water added to the ore particles. This method further supplies additive water from a water supply launder 105 in the width direction of the shaking table 102 as indicated by arrows 160 in FIG. 12.

In this case, low specific gravity ore particles having low specific gravity such as gangue minerals and sulfide minerals contained in the ore slurry supplied to the shaking table 102 go over the riffles 103 by the flow of the additive water supplied from the water supply launder 105 independently from the oscillation movement of the shaking table 102. Then, these low specific gravity ore particles fall toward a front side surface 102*c* of the shaking table 102 as indicated by arrows 150*a*, 150*b*, and 150*c* in FIG. 12, and are recovered as tailings into a first tailing recovery storage tank 108.

On the other hand, high specific gravity ore particles having high specific gravity shift in the extension direction of the riffles 103 in accordance with the oscillation movement of the shaking table 102, and flow out of the riffles 103 into a flat area 112 where the riffles 103 are not provided. Ore particles having large particle diameters are more likely to shift in the water flow direction of the additive water (width direction of the shaking table 102) by the flow of the additive water supplied from the water supply launder 105 or by others than ore particles having small particle diameters when the specific gravity of these large particle diameter and small particle diameter ore particles are the same. Accordingly, a stream 140*a* of high specific gravity, small particle diameter, and high gold grade ore particles, and a stream 140*b* of high specific gravity and large particle diameter ore particles are formed in the flat area 112. The stream 140*a* of high specific gravity, small particle diameter, and high gold grade ore particles is separated from the stream 140*b* of high specific gravity and large particle diameter ore particles by using a partition plate 107. The high specific gravity, small particle diameter, and high gold grade ore particles are recovered as concentrates into a concentrate recovery storage tank 110, while the high specific gravity and large particle diameter ore particles are recovered as tailings into a second tailing recovery storage tank 109. The part forming a stream of high gold grade ore particles is called a gold line.

The gold concentrates recovered by this method are directly smelted and casted, and produced into ingot products (called dore as well) having a purity of 90% or higher.

CITATION LIST

Patent Literature

Patent Literature 1: U.S. Pat. No. 6,818,042

Patent Literature 2: JP 2012-139675 A

It is generally essential to reduce imbalance of respective flow of ore slurry and additive water on the shaking table. For this purpose, technologies disclosed in Patent Literature 1 and Patent Literature 2 control the flow amount of supply water, the angle of the shaking table, and other conditions.

However, in the case of ore particles of gold ores, the imbalance of flow becomes large depending on the types of ores, and may produce both an area where flow is present and an area where flow is absent on the shaking table 102. Accordingly, in the case of ore particles of gold ores, the gold line may be cut, or may not be formed at the time of the imbalance of flow. These problems may deteriorate the efficiency of concentration operation.

More specifically, suppose that ore particles produced by pulverizing gold ores into an appropriate size (from 100 μm to 500 μm) are supplied as ore slurry containing a solid content ranging approximately 20% to 40% by weight, and that additive water is supplied from the water supply launder 105. In this case, it may occur that the ore slurry does not uniformly flow throughout the upper surface of the shaking table 102, but produces imbalance of flow thereon. Such imbalance of flow may reduce the advantage of the riffles 103 provided on the shaking table 102, and the advantage of the flat area 112 not containing the riffles 103 to an insufficient level, in which condition the efficiency of concentration of gold ores may decrease.

For overcoming these drawbacks, the supply amount from the water supply launder 105 is adjusted to such an amount as to eliminate the imbalance of flow of the ore slurry by increasing or decreasing the supply amount from the water supply launder 105. However, it may also occur that the amount of water flowing from the water supply launder 105 is imbalanced depending on the flow-out position of the water. When the amount of water is imbalanced, correction of the imbalance of flow of the ore slurry on the shaking table 102 becomes more difficult.

SUMMARY

The present invention has been developed to solve the aforementioned problems. It is an object of the present invention to provide such a water supply launder of a table gravity concentrator which reduces imbalance of the amount of water flowing from the water supply launder depending on the flow-out position of the water from the water supply launder even when the amount of water supplied to the water supply launder is varied. This water supply launder is therefore such a water supply launder capable of producing flow throughout the upper surface of at least a shaking table by reducing imbalance of the flow amounts of ore slurry and additive water on the shaking table.

According to the water supply launder of the table gravity concentrator of the present invention is a water supply launder included in a table gravity concentrator to supply water to a table of the table gravity concentrator, including: a launder body which receives water supplied from a water supply unit to an upper surface of the launder body, and supplies the water to the table of the table gravity concentrator; and a distribution member which is attached to a lower surface of the launder body, and contacts water dropping from the upper surface of the launder body and flowing to the table of the table gravity concentrator to distribute the water.

According to the water supply launder of the table gravity concentrator of the present invention, the distribution member attached to the lower surface of the launder body contacts the water dropping from the upper surface of the launder body and supplied to the table of the table gravity concentrator, and disperses the water almost uniformly to balance the flow amount for each position. In this case, the water supply launder reduces imbalance of the amount of water flowing from the water supply launder depending on the flow-out position even when the amount of supplied water is varied. Accordingly, the water supply launder reduces imbalance of the flow amounts of slurry and additive water on the table, and forms flow throughout the whole surface of the table during concentration operation.

DETAILED DESCRIPTION

A water supply launder of a table gravity concentrator according to the present invention is hereinafter described in detail with reference to the drawings. The present invention is not limited to the examples described herein, but may be modified in arbitrary manners without departing from the scope of the present invention.

Figure 1:
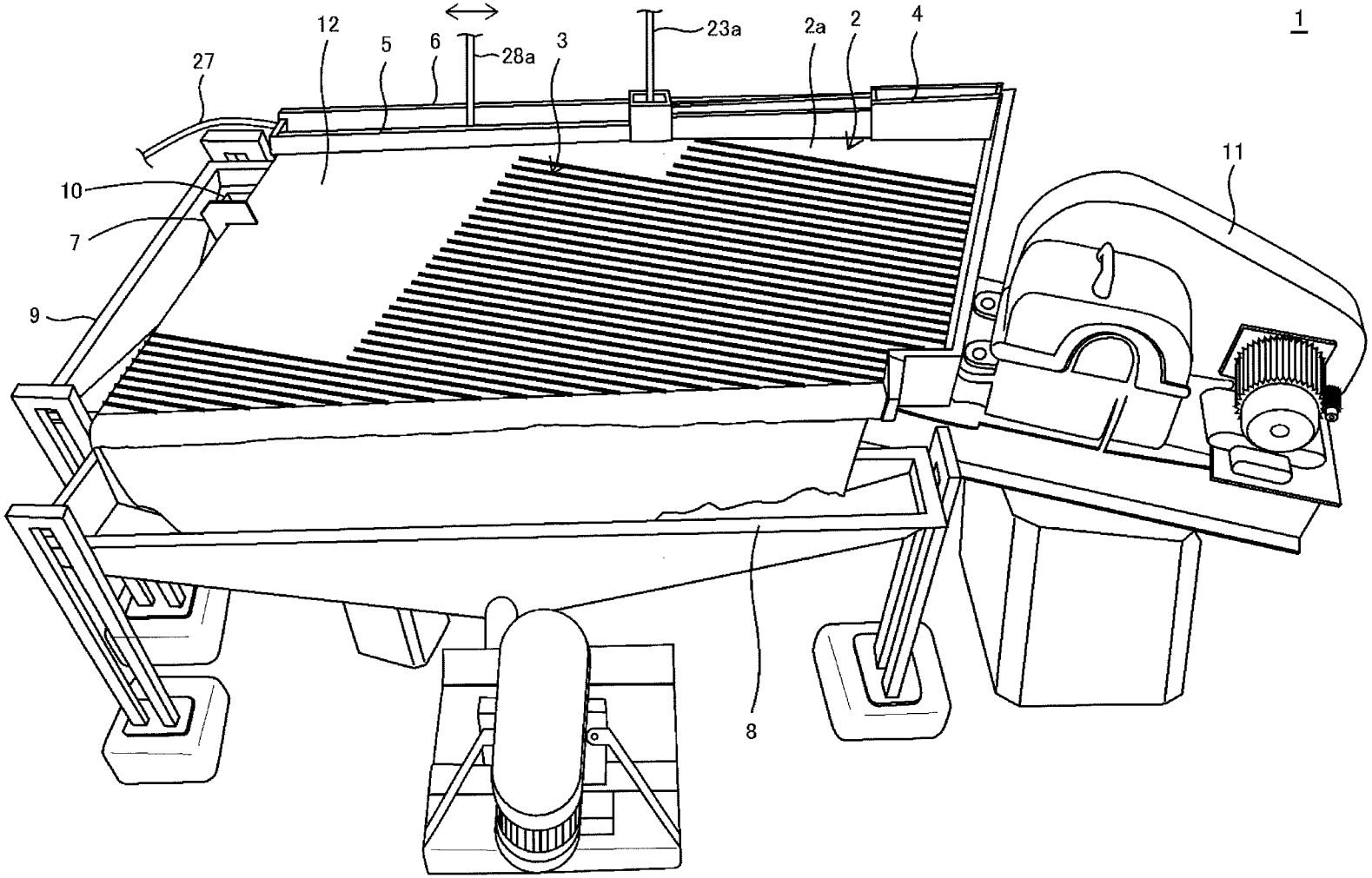
FIG. 1 is a perspective view illustrating a table gravity concentrator.
Figure 2:
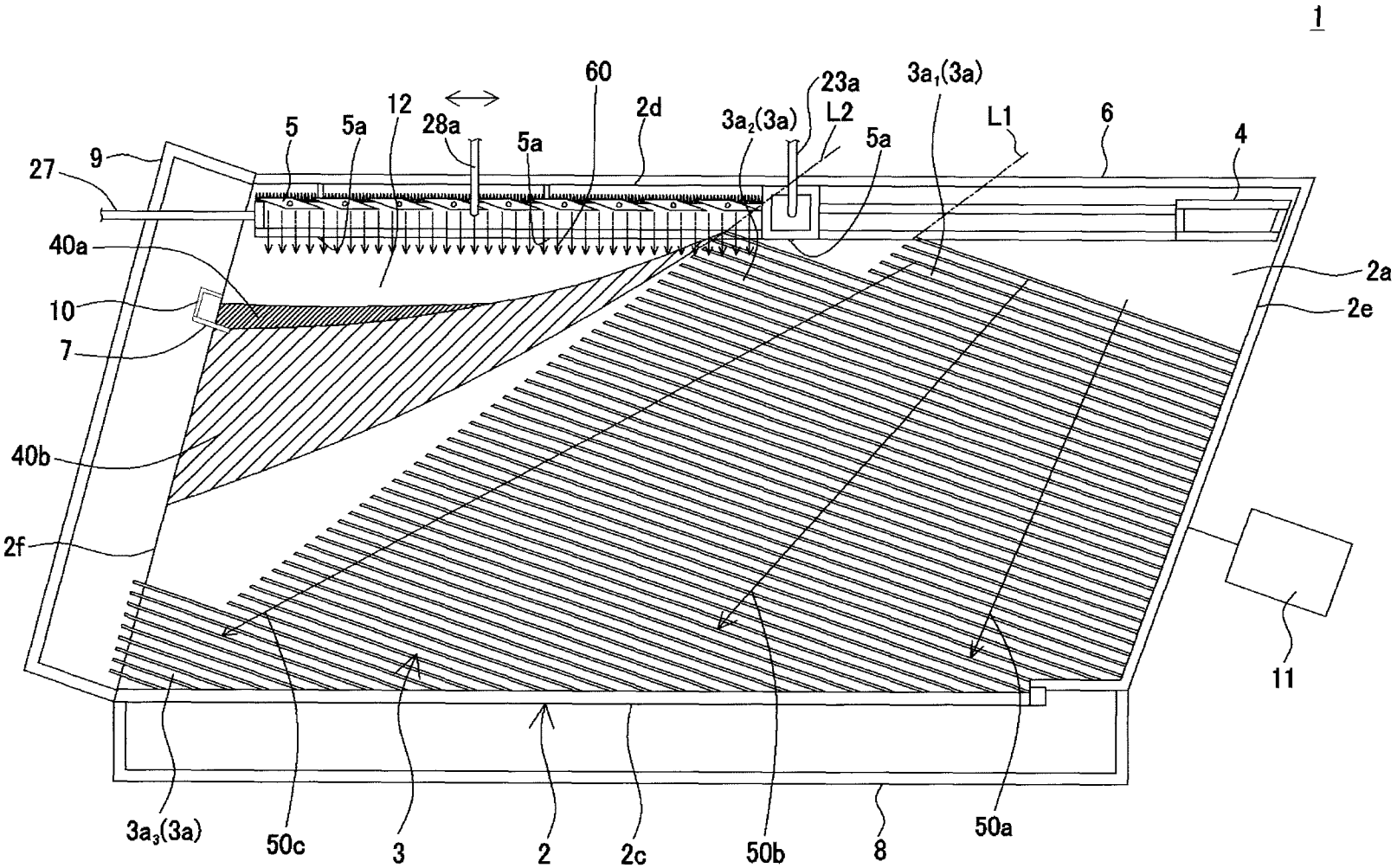
FIG. 2 is a plan view illustrating the table gravity concentrator.

As illustrated in FIGS. 1 and 2, a table gravity concentrator 1 includes a shaking table 2 provided with riffles 3, an ore supply launder 4 through which ore slurry is supplied to an upper surface 2*a* of the shaking table 2, a water supply launder 5 through which additive water is supplied to the upper surface 2*a* of the shaking table 2, a dam 6 for damming up the ore slurry and the additive water supplied from the ore supply launder 4 and the water supply launder 5 so as to prevent the ore slurry and the additive water from falling from the upper surface 2*a* of the shaking table 2, a partition plate 7 for separating gold concentrates from tailings, first and second tailing recovery storage tanks 8 and 9 into which tailings are recovered, and a concentrate recovery storage tank 10 into which gold concentrates are recovered.

As illustrated in FIGS. 1 and 2, the shaking table 2 is constituted by a wooden plate component or the like having a parallelogrammatic shape in the plan view, or a plate component in which a wooden plate component is laminated on a metal plate component, for example. An example of the shaking table 2 is a plate unit parallelogrammatically shaped in the plan view, and sized to have a length of 99.8 inches in the length direction between a right side surface 2*e* and a left side surface 2*f*, and a length of 52.5 inches in the width direction between a front side surface 2*c* and a rear side surface 2*d* (the width direction is perpendicular to the length direction), a length of 4 inches in the thickness direction between the upper surface 2*a* and a lower surface 2*b*, and an angle of 70.5 degrees formed by the front side surface 2*c* and the left side surface 2*f*. The foregoing respective lengths and angles and other conditions of the shaking table 2 are presented by way of example only, and may be arbitrarily varied as necessary.

As illustrated in FIGS. 1 and 2, a plurality of riffles 3 projecting upward are provided on the upper surface 2*a* of the shaking table 2. The riffles 3 are disposed throughout the upper surface 2*a* of the shaking table 2 other than an area around the left rear corner of the upper surface 2*a* and the rear side surface 2*d* of the shaking table 2, for example. In addition, the riffles 3 are disposed on the upper surface 2*a* of the shaking table 2 with a predetermined angle formed by the riffles 3 and the length direction (width direction) of the shaking table 2. The riffles 3 will be detailed later.

As illustrated in FIGS. 1 and 2, the shaking table 2 is supported on a support table (not shown) in such a condition as to oscillate via an oscillation support mechanism (not shown) such as rails, for example, and is oscillated in the extension direction of the riffles 3 by an oscillation driving mechanism 11. Moreover, the rear side surface 2*d* of the shaking table 2 is positioned higher than the front side surface 2*c* such that the upper surface 2*a* has a slope (inclination). For example, the upper surface 2*a* of the shaking table 2 is so disposed as to have a slope (inclination) of 6 degrees with respect to the horizontal plane. The foregoing angle and other conditions of the shaking table 2 are presented by way of example only, and may be arbitrarily varied as necessary.

As illustrated in FIGS. 1 and 2, the ore supply launder 4 is provided on the upper surface 2*a* of the shaking table 2 on the rear side surface 2*d* side and closer to the right side surface 2*e* side. The ore supply launder 4 is attached to the dam 6, for example, and successively supplies ore slurry to the upper surface 2*a* of the shaking table 2. The ore slurry is produced by pulverizing gold ores into the ore particles and additive water thereto. The ore slurry supplied from the ore supply launder 4 flows from the right rear corner of the upper surface 2*a* of the shaking table 2 toward the front side surface 2*c*, the left front corner of the upper surface 2*a*, the left side surface 2*f* or other areas in accordance with the slope (inclination) of the upper surface 2*a* of the shaking table 2, and the specific gravity and particle diameters of the ore particles contained in the ore slurry, as indicated by arrows 50*a*, 50*b*, and 50*c* in FIG. 2.

As illustrated in FIGS. 1 and 2, the water supply launder 5 is provided on the upper surface 2*a* of the shaking table 2 on the rear side surface 2*d* side and closer to the left surface side 2*f* side. The water supply launder 5 is attached to the dam 6 at a position adjacent to the left side surface 2*f* side of the ore supply launder 4, for example, and successively supplies additive water to the upper surface 2*a* of the shaking table 2. The additive water supplied from the water supply launder 5 flows from the rear side surface 2*d* side of the shaking table 2 toward the front side surface 2*c* side (width direction of the shaking table 2) in accordance with the slope (inclination) of the upper surface 2*a* of the shaking table 2, as indicated by arrows 60 in FIG. 2. The water supply launder 5 will be detailed later.

The ore supply launder 4 and the water supply launder 5 may be formed integrally with each other and constitute a launder unit. The ore supply launder 4 and the water supply launder 5 are not limited to be attached to the dam 6. Alternatively, the ore supply launder 4 and the water supply launder 5 may be attached to the shaking table 2, or other constituent elements of the table gravity concentrator 1.

As illustrated in FIGS. 1 and 2, the wall-shaped dam 6 is provided on the rear side surface 2*d*, the right side surface 2*e*, and a part of the front side surface 2*c* on the right side surface 2*e* side of the shaking table 2. The dam 6 is attached to the respective side surfaces 2*d*, 2*e*, and 2*c* of the shaking table 2 in such a manner that the upper end of the dam 6 projects upward from the upper surface 2*a* of the shaking table 2. For example, the dam 6 is sized to have a width of 1 inch, a length of 9 inches in the thickness direction between the upper surface 2*a* and the lower surface 2*b* of the shaking table 2, and is so attached to the respective side surfaces 2*d*, 2*e*, and 2*c* of the shaking table 2 as to project from the upper surface 2*a* of the shaking table 2 by 5 inches. According to this structure, the ore slurry supplied from the ore supply launder 4 to the upper surface 2*a* of the shaking table 2, and the additive water supplied from the water supply launder 5 to the upper surface 2*a* of the shaking table 2 are prevented from falling from the rear side surface 2*d* and the right side surface 2*e* of the shaking table 2 by the function of the dam 6. The foregoing width, the length, the projection and other conditions of the dam 6 are presented by way of example only, and may be arbitrarily varied as necessary.

As illustrated in FIGS. 1 and 2, the plural riffles 3 are provided throughout the upper surface 2*a* of the shaking table 2 other than the area around the left rear corner of the upper surface 2*a* and the rear side surface 2*d* of the shaking table 2, for example. The riffles 3 are disposed on the upper surface 2*a* of the shaking table 2 with a predetermined angle formed by the riffles 3 and the length direction (width direction) of the shaking table 2.

Each of the riffles 3 is formed by a long member, for example. A plurality of the riffles 3 are disposed on the upper surface 2*a* of the shaking table 2 at uniform intervals while inclined at a predetermined angle with respect to the length direction (front side surface 2*c*) of the shaking table 2. For example, each of the riffles 3 is a long member having a width of 0.3 inches, and a length of 1 inch in the thickness direction between the upper surface 2*a* and the lower surface 2*b* of the shaking table 2. The sixty riffles 3 are disposed on the upper surface 2*a* of the shaking table 2 at uniform intervals while inclined at 19.5 degrees toward the rear side surface 2*d* of the shaking table 2 with respect to the length direction (front side surface 2*c*) of the shaking table 2, in other words, inclined at 90 degrees with respect to the right side surface 2*e* (left side surface 2*f*) of the shaking table 2. The foregoing width, length, angle, number and other conditions of the riffles 3 are presented by way of example only, and may be arbitrarily varied as necessary.

The riffles 3 are constituted by upstream riffles $\mathbf{3}a_1$, midstream riffles $\mathbf{3}a_2$, and downstream riffles $\mathbf{3}a_3$. The upstream riffles $\mathbf{3}a_1$, midstream riffles $\mathbf{3}a_2$, and downstream riffles $\mathbf{3}a_3$ are disposed in this order on the upper surface 2*a* of the shaking table 2 from the rear side surface 2*d* side toward the front side surface 2*c* side of the shaking table 2. Each unit of the upstream riffles $\mathbf{3}a_1$, midstream riffles $\mathbf{3}a_2$, and downstream riffles $\mathbf{3}a_3$ is constituted by a plurality of riffles.

The upstream riffles $\mathbf{3}a_1$ are so provided as to gradually increase in length from the rear side surface 2*d* toward the front side surface 2*c* of the shaking table 2. For example, the upstream riffles $\mathbf{3}a_1$ are so provided that a line L1 connecting the left side surface 2*f* side tips of the upstream riffles $\mathbf{3}a_1$ is inclined at an angle of 37.4 degrees toward the rear side surface 2*d* with respect to the length direction of the shaking table 2, that is, inclined at an angle of 52.6 degrees toward the right side surface 2*e* with respect to the width direction of the shaking table 2. In other words, the upstream riffles $\mathbf{3}a_1$ are so provided that an angle of 123.1 degrees is formed by the extension direction of the midstream riffles $\mathbf{3}a_2$ and the line L1 connecting the tips of the upstream riffles $\mathbf{3}a_1$.

The midstream riffles $\mathbf{3}a_2$ are longer than the upstream riffles $\mathbf{3}a_1$ in the extension direction. Similarly to the upstream riffles $\mathbf{3}a_1$, the midstream riffles $\mathbf{3}a_2$ are so provided as to gradually increase in length from the rear side surface 2*d* toward the front side surface 2*c* of the shaking table 2. For example, similarly to the upstream riffles $\mathbf{3}a_1$, the midstream riffles $\mathbf{3}a_2$ are so provided that a line L2 connecting the left side surface 2*f* side tips of the midstream riffles $\mathbf{3}a_2$ is inclined at an angle of 37.4 degrees toward the rear side surface 2*d* with respect to the length direction of the shaking table 2, that is, inclined at an angle of 52.6 degrees toward the right side surface 2*e* with respect to the width direction of the shaking table 2. In other words, the midstream riffles $\mathbf{3}a_2$ are so provided that an angle of 123.1 degrees is formed by the extension direction of the downstream riffles $\mathbf{3}a_3$ and the line L2 connecting the tips of the midstream riffles $\mathbf{3}a_2$. Accordingly, the line L2 connecting the tips of the midstream riffles $\mathbf{3}a_2$ is so defined as to become parallel with the line L1 connecting the tips of the upstream riffles $\mathbf{3}a_1$.

The downstream riffles $\mathbf{3}a_3$ extend from the upper surface 2*a* toward the left side surface 2*f* of the shaking table 2.

The foregoing angles of the line L1 connecting the tips of the upstream riffles $\mathbf{3}a_1$ and L2 connecting the tips of the midstream riffles $\mathbf{3}a_2$ are presented by way of example only and not limited to these. These angles of the likes L1 and L2 may be arbitrarily varied as necessary. Moreover, the angles of the line L1 connecting the tips of the upstream riffles $\mathbf{3}a_1$ and L2 connecting the tips of the midstream riffles $\mathbf{3}a_2$ are not required to be the same. These angles of the lines L1 and L2 may be set different from each other.

A flat area 12 is provided at the left rear corner of the upper surface 2*a* of the shaking table 2. The flat area 12 is an area where the riffles 3 are not formed. The flat area 12 has a substantially triangular shape in the plan view. As illustrated in FIG. 2, a gold line 40*a* is generated in the flat area 12 when ore particles constituted by gold ores and supplied together with the additive water are concentrated by riffles 3 based on specific gravity of the ore particles. For example, the gold line 40*a* is generated from the left side surface 2*f* side tip of the midstream riffle $3a_2$ located at the position closest to the rear side surface 2*d* (uppermost row) in the riffles 3, and extends toward the flat area 12 of the shaking table 2. The gold line 40*a* in the flat area 12 flows toward the left side surface 2*f* of the shaking table 2.

The riffles 3 thus constructed are formed on the upper surface 2*a* of the shaking table 2 in the manner as follows, for example. Long members made of rubber or resin and constructed in correspondence with the foregoing riffles 3 are affixed to a body sheet formed by a rubber sheet or a resin sheet slightly larger than the shaking table 2. Then, the body sheet to which the riffles 3 are attached is placed on the upper surface 2*a* of the wooden shaking table 2 and attached to the upper surface 2*a* by staplers or the like to form the riffles 3 on the upper surface 2*a* of the shaking table 2. For example, the body sheet and the long members, that is, the riffles 3, are made of linoleum.

The material of the riffles 3 is not limited to linoleum, but may be rubber material, resin material, metal material, or other known materials. The riffles 3 are not limited to be provided by the method discussed herein which attaches the body sheet provided with long members to the upper surface 2*a* of the shaking table 2 to form the riffles 3 on the upper surface 2*a* of the shaking table 2. Alternatively, the riffles 3 may be directly attached to the upper surface 2*a* of the shaking table 2 to be formed thereon. In addition, the shaking table 2 is not limited to a wooden component, but may be a component made of metal or resin.

As illustrated in FIGS. 3 through 10, the water supply launder 5 includes a launder body 20, and a distribution member 30 attached to the launder body 20. The distribution member 30 contacts water dropping from the launder body 20 and supplied to the shaking table 2 to distribute the water.

Figure 10:
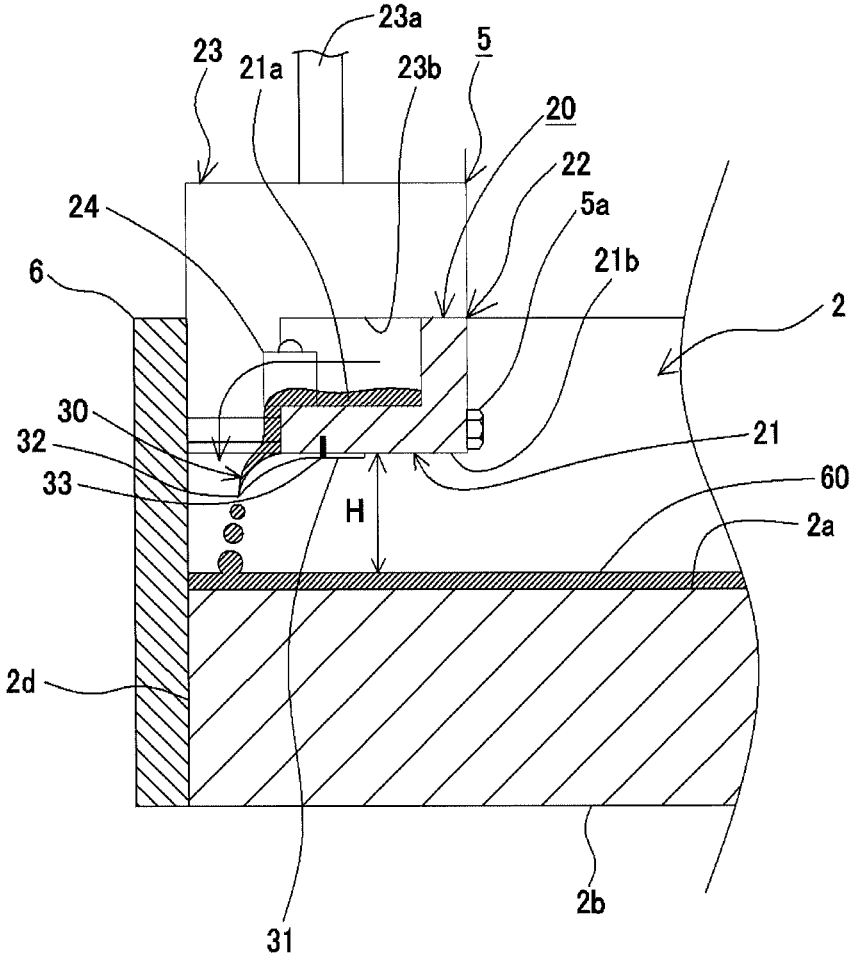
FIG. 10 is a cross-sectional side view illustrating the table gravity concentrator.

As illustrated in FIGS. 3 through 10, the launder body 20 includes a bottom unit 21, and a front unit 22 attached to an end of the bottom unit 21 in the width direction such that the front unit 22 crosses the bottom unit 21 at right angles. The launder body 20 is an L-shaped wooden long member which is long in the length direction crossing the width direction at right angles. As illustrated in FIG. 10, the launder body 20 is attached to the dam 6 via attachment members 5*a* such as bolts. In this case, the launder body 20 is positioned with the front unit 22 facing to the front side surface 2*c* of the shaking table 2, and disposed substantially in parallel with the dam 6 and away from the dam 6 by a predetermined distance, and also away from the upper surface 2*a* of the shaking table 2 by a predetermined distance. For example, the launder body 20 is sized such that both the bottom unit 21 and the front unit 22 have a thickness of 1 inch, and is constituted by an L-shaped long member as a whole having a length of 49.9 inches in the length direction of the shaking table 2, a length of 3.5 inches in the width direction of the shaking table 2, and a length (height) of 2.5 inches in the thickness direction of the shaking table 2. The launder body 20 is disposed away from the upper surface 2*a* of the shaking table 2 by 2 inches. The foregoing thickness, lengths and other conditions of the launder body 20 are presented by way of example only, and may be arbitrarily varied as necessary.

The water supply launder 5 is not required to be attached to the dam 6 by bolts, but may be attached to the dam 6 by known attachment members other than bolts. The water supply launder 5 may be attached to the shaking table 2, or other constituent elements of the table gravity concentrator 1.

As illustrated in FIGS. 3 through 10, a water supply unit 23 is provided at an end of an upper surface 21*a* of the bottom unit 21 of the launder body 20 in the length direction. The water supply unit 23 is a unit for supplying water to the upper surface 21*a* of the bottom unit 21. The water supply unit 23 is constituted by a wooden square-tube-shaped component, for example, as a unit to which a water supply hose 23*a* is connected, or into which the water supply hose 23*a* is inserted. For example, the water supply unit 23 is constituted by a square-tube-shaped component sized to have a length of 5.5 inches in the length direction of the shaking table 2, a length of 6.0 inches in the width direction of the shaking table 2, and a length of 5.0 inches in the thickness direction of the shaking table 2. The foregoing lengths of the water supply unit 23 are presented by way of example only, and may be arbitrarily varied as necessary.

Figure 3:
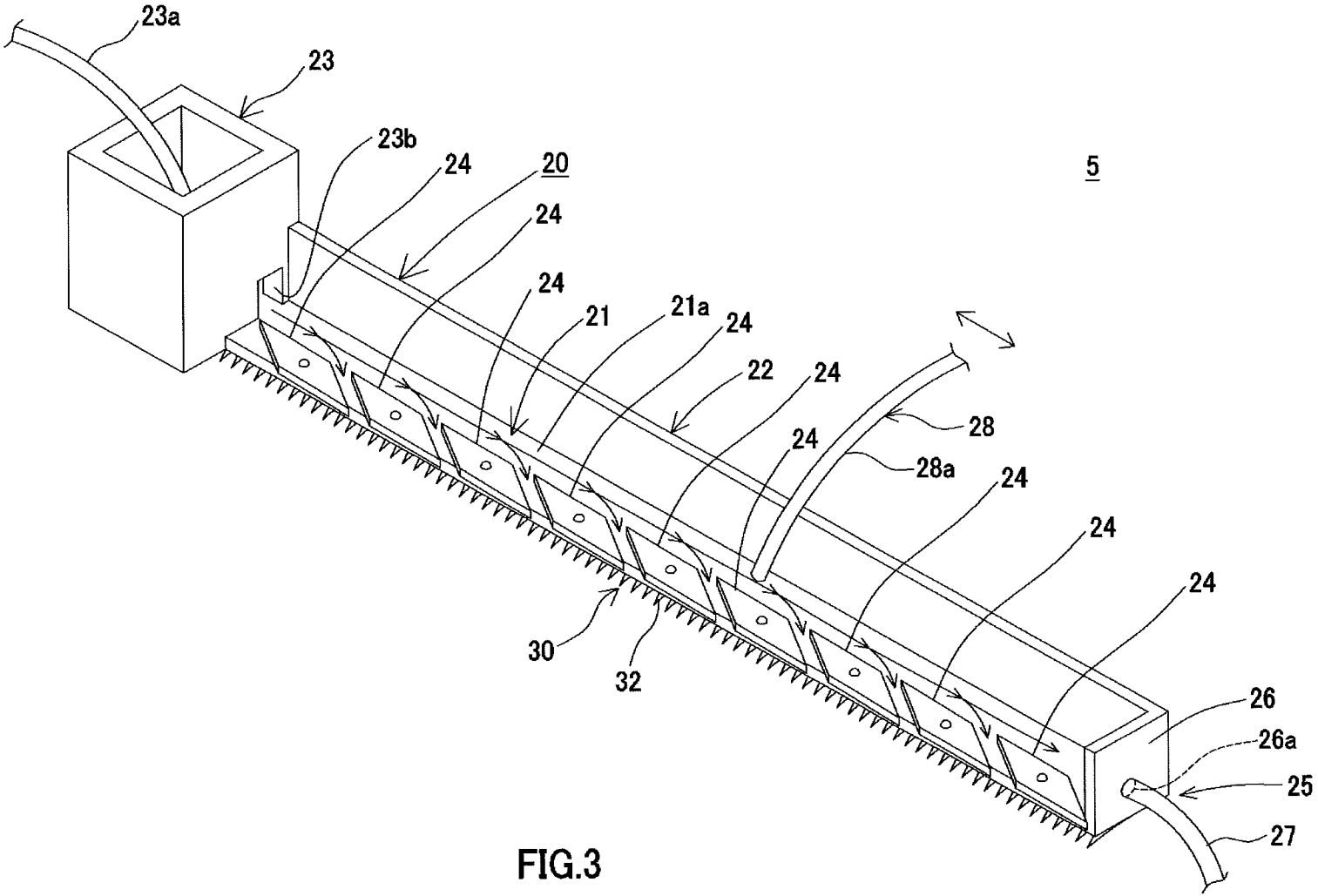
FIG. 3 is a perspective view illustrating a water supply launder.
Figure 4:
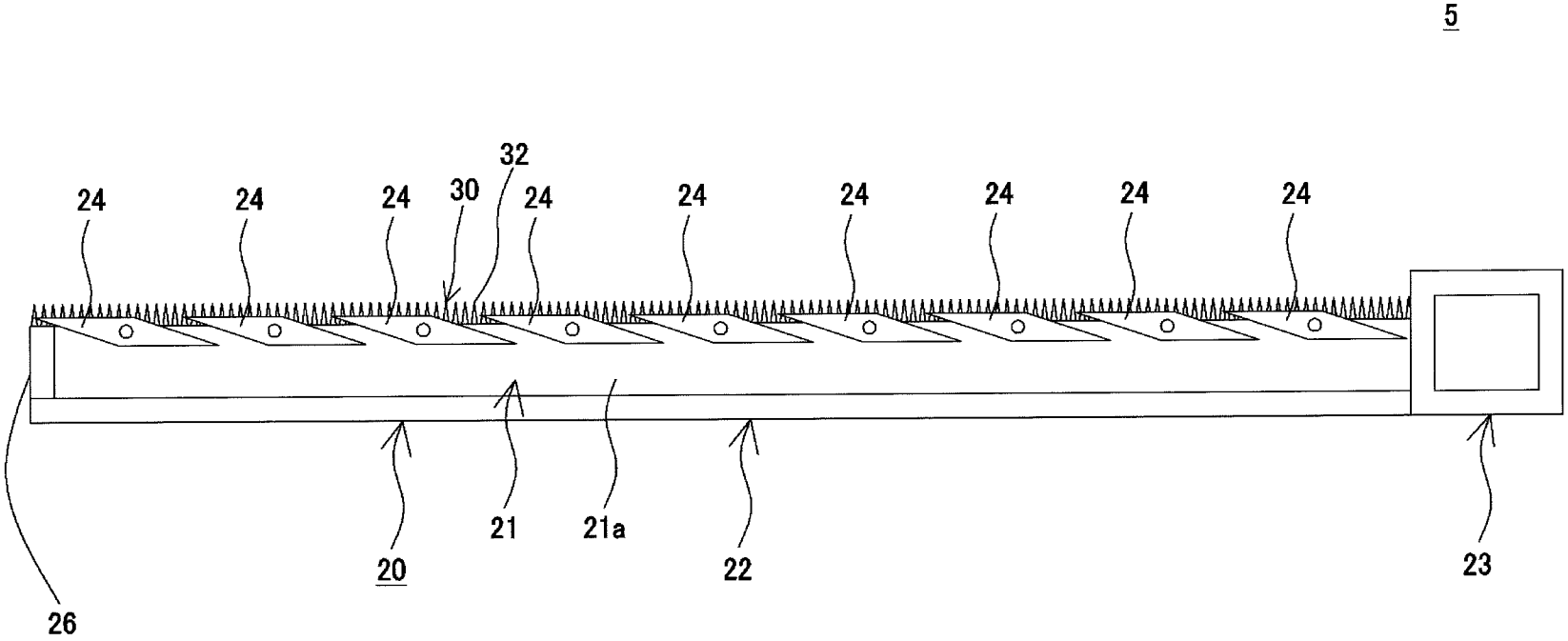
FIG. 4 is a plan view illustrating the water supply launder.

As illustrated in FIGS. 3 and 10, the water supply unit 23 supplies water to the upper surface 21*a* of the bottom unit 21. This water flows from the water supply hose 23*a*, through an opening 23*b*, and toward the upper surface 21*a* of the bottom unit 21. The water supplied from the water supply unit 23 to the upper surface 21*a* of the bottom unit 21 flows through the upper surface 21*a* of the bottom unit 21 in the direction from one end to the other end in the length direction as illustrated in FIG. 3, while dropping from the other end (dam 6 side) of the bottom unit 21 in the width direction onto the upper surface 2*a* of the shaking table 2 as illustrated in FIG. 10.

The water supply unit 23 may be constituted only by the water supply hose 23*a*. In this case, water is directly supplied from the water supply hose 23*a* to the upper surface 21*a* of the bottom unit 21. In addition, while it is preferable that the water supply hose 23*a* is equipped on the water supply unit 23, other any known types of tubes may be used in lieu of the water supply hose 23*a* as long as these tubes can supply water to the upper surface 21*a* of the bottom unit 21 directly or via a square-tube-shaped component.

As illustrated in FIGS. 3 through 10, dispersing members 24 are provided on the upper surface 21*a* of the bottom unit 21 of the launder body 20. The dispersing members 24 disperse water supplied from the water supply unit 23 to the upper surface 21*a* of the bottom unit 21 and drop the water from the dam 6 side. The dispersing members 24 are rhombic or rectangular plate components in the plan view, and made of rubber, for example. A plurality of the dispersing members 24 are provided on the upper surface 21*a* of the bottom unit 21 from the one end to the other end in the length direction at uniform intervals while inclined at a predetermined angle with respect to the width direction of the bottom unit 21. For example, each of the dispersing members 24 is a plate component sized to have a length of 6.5 inches, a width of 1.0 inch, and a thickness of 1.3 inches. In addition, the nine dispersing members 24 in total are disposed on the upper surface 21*a* of the bottom unit 21 in an area between a position 3.0 inches away from the water supply unit 23 and the other end of the upper surface 21*a* in the length direction at intervals of 5.4 inches. The foregoing length, width, thickness, arranged intervals, arranged number, and other conditions of the dispersing members 24 are presented by way of example only, and may be arbitrarily varied as necessary. Each of the dispersing members 24 is detachably attached to the upper surface 21*a* of the bottom unit 21 by a fastening component such as a bolt in such a manner that the angle of the dispersing member 24 with respect to the width direction (length direction) of the bottom unit 21 is adjustable. According to this structure, the dispersing members 24 disperse the water flowing from the water supply unit 23 to the upper surface 21*a* of the bottom unit 21 between the dispersing members 24 and the front unit 22 such that the water can drop from the dam 6 side uniformly throughout the range from the one end to the other end in the length direction of the bottom unit 21 by adjusting the angles of the dispersing members 24 and thereby controlling the amounts of respective parts of water flowing between the dispersing members 24.

As illustrated in FIGS. 3 through 10, a discharge unit 25 is provided at the other end of the upper surface 21*a* of the bottom unit 21 of the launder body 20 in the length direction. The discharge unit 25 is a component through which water supplied from the water supply unit 23 to the upper surface 21*a* of the bottom unit 21 is discharged to the outside. The discharge unit 25 includes a discharge port 26*a* formed in a left side unit 26, and a discharge hose 27 connected with the discharge port 26*a*. The left side unit 26 is a unit provided at the other end of the bottom unit 21 in the length direction and crossing the bottom unit 21 at right angles. When water supplied from the water supply unit 23 to the upper surface 21*a* of the bottom unit 21 reaches the left side unit 26 at the other end in the length direction, the discharge unit 25 rapidly discharges the water to the outside via the discharge port 26*a* using the discharge hose 27.

Accordingly, the discharge unit 25 prevents overflow of water to the outside caused when the water flowing through the upper surface 21*a* of the bottom unit 21 from the one end toward the other end in the length direction collides with the left side unit 26 and goes over the left side unit 26. Moreover, the discharge unit 25 prevents water from returning toward the one end in the length direction when the water flowing through the upper surface 21*a* of the bottom unit 21 collides with the left side unit 26. Furthermore, the discharge unit 25 prevents a large amount of water from dropping from the dam 6 side, and also from going over the front unit 22 and overflowing to the outside, when the water having collided with the left side unit 26 and returned toward the one end in the length direction collides with subsequent water flowing toward the other end in the length direction.

As illustrated in FIGS. 3 through 10, the launder body 20 includes a movable sub water supply unit 28 for additive water supply to an arbitrary position. For example, the sub water supply unit 28 is constituted by a sub water supply hose 28*a* supported by a not-shown sliding support member or the like capable of sliding in the length direction of the bottom unit 21. The sub water supply unit 28 is disposed at an arbitrary position of the bottom unit 21 in the length direction to supply water.

According to this structure, the sub water supply unit 28 performs finer control of the flow amount of water flowing through the upper surface 21*a* of the bottom unit 21. Accordingly, imbalance of flow more securely decreases, and the water flowing through the upper surface 21*a* of the bottom unit 21 more uniformly drops from the dam 6 side. Moreover, the sub water supply unit 28 located at an arbitrary position of the bottom unit 21 in the length direction to supply water can increase the water supply amount intentionally and partially. In this case, the sub water supply unit 28 can supply additive water increased intentionally and partially to ore particles staying in an island shape on the upper surface 2*a* of the shaking table 2 for reasons of various failures, for example, so as to eliminate the staying ore particles. Accordingly, the sub water supply unit 28 reduces time and labor for eliminating the failures, and therefore increases the operation time.

According to the launder body 20 thus constructed, when water is supplied from the water supply unit 23 to the upper surface 21*a* of the bottom unit 21 between the dispersing members 24 and the front unit 22 from the one end to the other end in the length direction, the water is dispersed by the dispersing members 24 in such a manner that the amount of dropping water becomes substantially uniform from the one end to the other end of the bottom unit 21 in the length direction, while guided toward the dam 6. The guided water is thereby supplied from the dam 6 side bottom unit 21 toward the shaking table 2.

Figure 5:
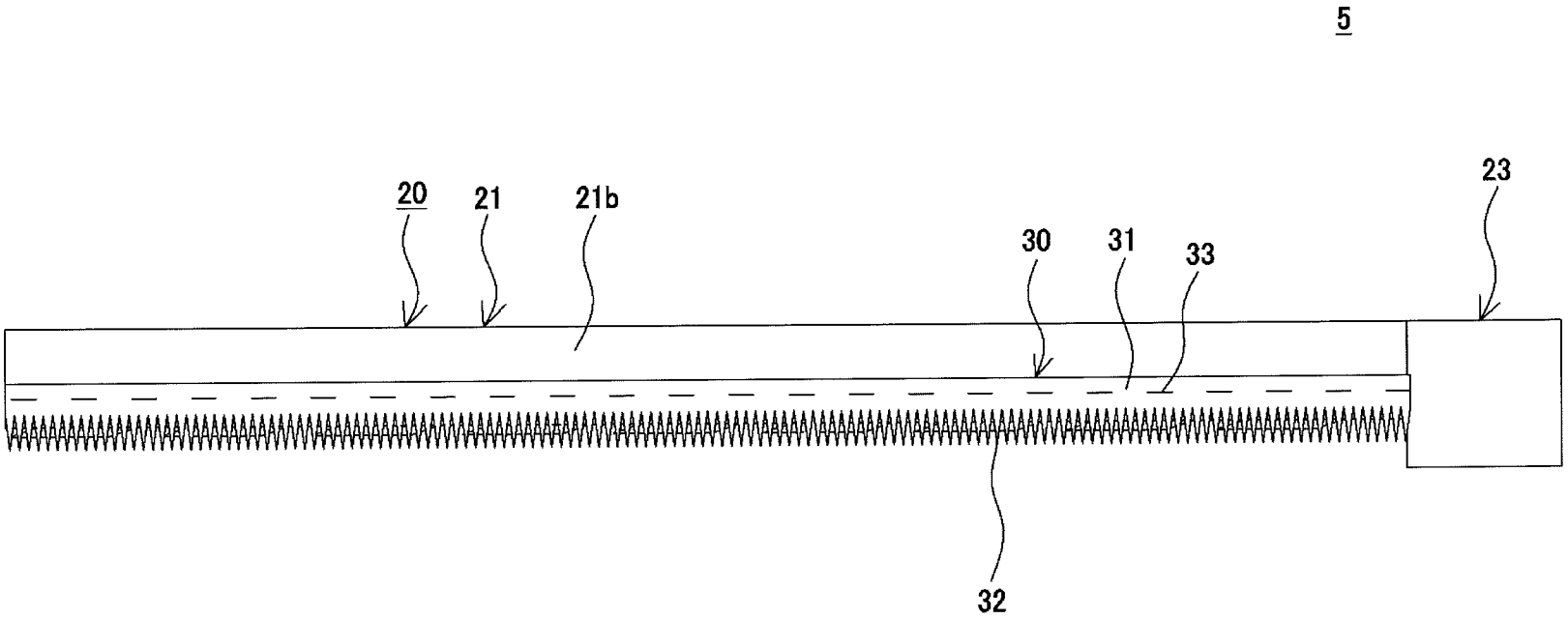
FIG. 5 is a bottom view illustrating the water supply launder.
Figure 6:
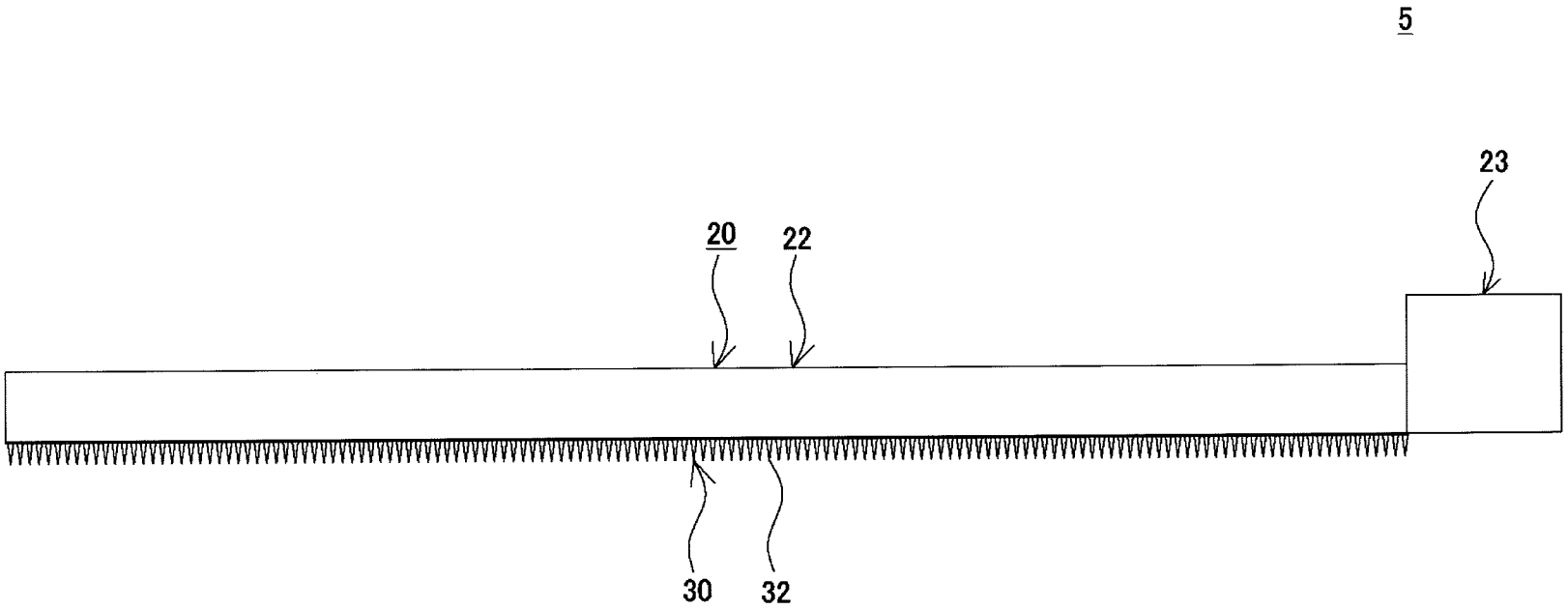
FIG. 6 is a front view illustrating the water supply launder.
Figure 7:
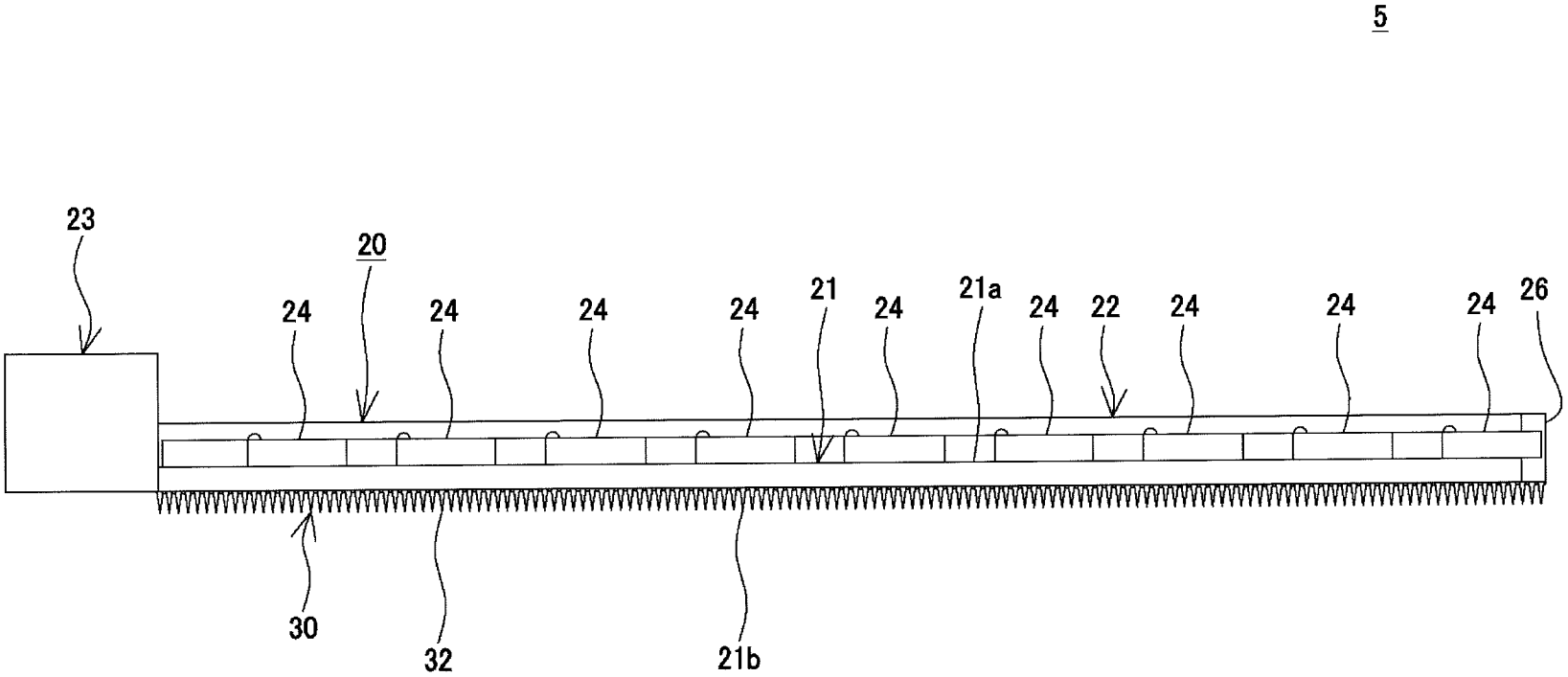
FIG. 7 is a back view illustrating the water supply launder.
Figure 8:
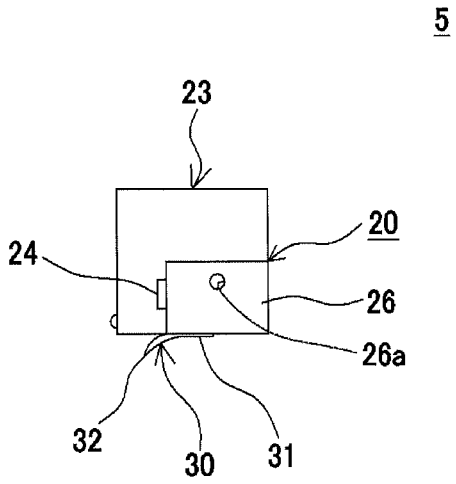
FIG. 8 is a left side view illustrating the water supply launder.
Figure 9:
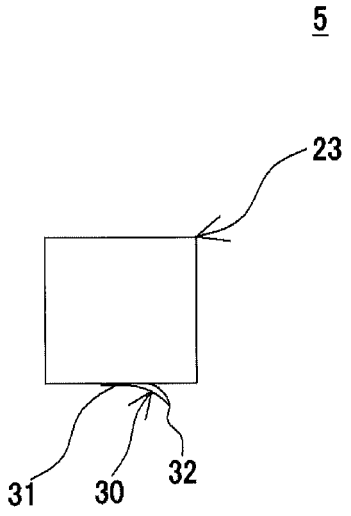
FIG. 9 is a right side view illustrating the water supply launder.
Figure 11:
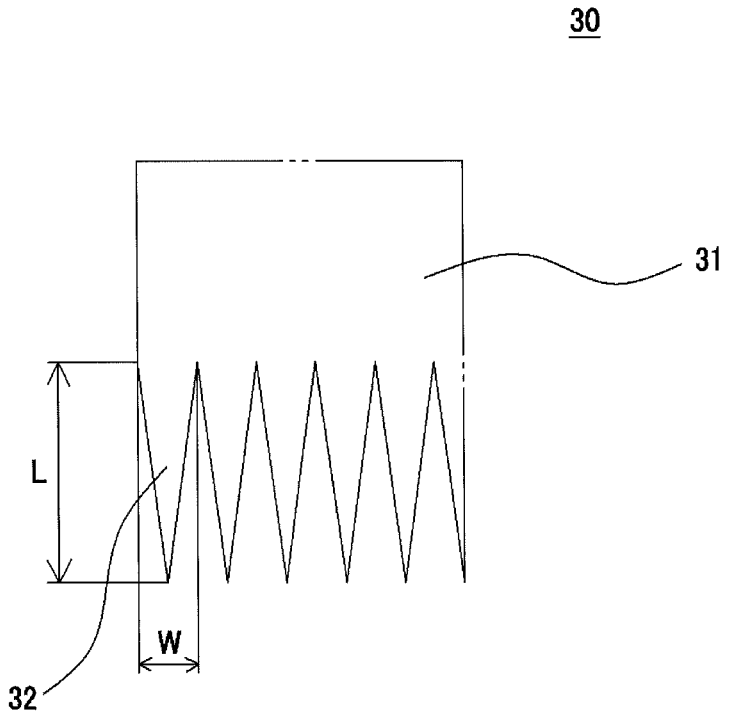
FIG. 11 is a plan view illustrating a distribution member.
Figure 12:
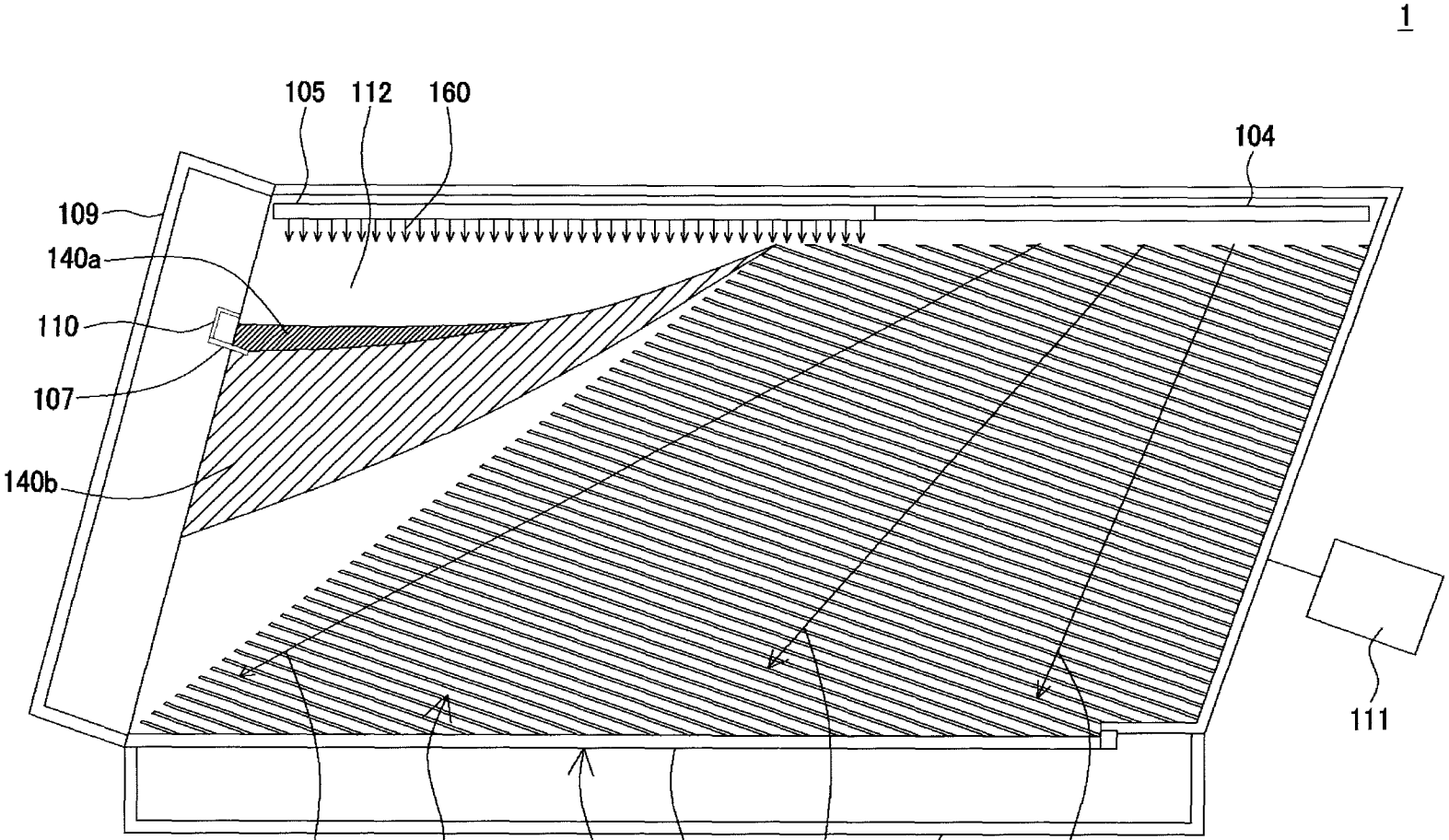
FIG. 12 is a plan view illustrating a conventional table gravity concentrator.

As illustrated in FIGS. 3 through 11, the distribution member 30 is attached to a lower surface 21*b* of the bottom unit 21 of the launder body 20, and contacts the water dropping from the dam 6 side launder body 20 and supplied to the shaking table 2 so as to distribute the water. More specifically, as illustrated in FIGS. 5 and 11, the distribution member 30 includes a plurality of triangular skirts 32 forming a serrate shape and disposed on a rectangular body 31 of the distribution member 30. The distribution member 30 is made of resin material such as polyvinyl chloride, and has flexibility.

As illustrated in FIG. 5, the distribution member 30 has substantially the same length as the length of the bottom unit 21 in the length direction. The distribution member 30 is attached to the lower surface 21*b* of the bottom unit 21 via staplers 33 fastening the body 31 to the lower surface 21*b* of the bottom unit 21. Thus, the distribution member 30 is provided throughout the range of the bottom unit 21 in the length direction. In this case, the distribution member 30 is attached to the lower surface 21*b* of the bottom unit 21 in such a manner that the skirt 32 projects from the bottom unit 21 toward the dam 6.

As illustrated in FIG. 11, the distribution member 30 is so formed that a relation $W=0.5\ L$ holds assuming that the width and length of each of the skirts 32 are W and L, respectively. In addition, as illustrated in FIGS. 10 and 11, the distribution member 30 is so provided that a relation $0.3\ H \leq L \leq 0.5\ H$ holds assuming that the length of each of the skirts 32 and the distance between the lower surface 21*b* of the bottom unit 21 of the launder body 20 and the upper surface 2*a* of the shaking table 2 are L and H, respectively.

For example, the body 31 of the distribution member 30 is so sized as to have a length of 50 inches, and a width of 2.5 inches. Each of the skirts 32 is so sized as to have the length L of 0.8 inches, and the width W of 0.4 inches. The body 31 and each of the skirts 32 have the same thickness of 0.2 inches. The foregoing lengths, widths, thicknesses and other conditions of the distribution member 30 are presented by way of example only, and may be arbitrarily varied as necessary.

As illustrated in FIG. 10, the skirts 32 of the distribution member 30 thus constructed contact the water dropping from the dam 6 side upper surface 21*a* of the bottom unit 21 of the launder body 20 and supplied to the shaking table 2. In this case, the distribution member 30 decreases the force of the water contacting the distribution member 30, and disperses the water almost uniformly. Accordingly, the distribution member 30 reduces imbalance of the amount of water supplied from the water supply launder 5 depending on the flow-out position from the water supply launder 5 even when the amount of water supplied to the water supply launder 5 varies, and therefore produces flow of water throughout the upper surface 2*a* of the shaking table 2.

The distribution member 30 may be constituted by a plurality of components each of which is shorter than the length of the bottom unit 21 in the length direction and attached to the lower surface 21*b* of the bottom unit 21. In this case, these components are provided throughout the range of the lower surface 21*b* of the bottom unit 21 in the length direction.

The distribution member 30 is not limited to be attached to the lower surface 21*b* of the bottom unit 21 via the staplers 33, but may be attached by any known attachment units or attachment methods such as bonding by adhesives and fastening by bolts.

The material of the distribution member 30 is not limited to polyvinyl chloride, but may be other resin materials as long as these materials provide flexibility of the skirts 32, decrease the force of water, and disperse water almost uniformly.

Each of the skirts 32 of the distribution member 30 is not limited to have a triangular shape, but may have other shapes such as rectangular and semicircular shapes as long as the skirts 32 have flexibility, decrease the force of water, and disperse water almost uniformly.

The table gravity concentrator 1 thus constructed recovers gold concentrates from gold ores containing gangue minerals or sulfide minerals in the manner as follows.

Initially, as illustrated in FIG. 2, the shaking table 2 of the table gravity concentrator 1 is oscillated in the extension direction of the riffles 3 by the oscillation driving mechanism 11. According to the table gravity concentrator 1, ore slurry is successively supplied from the ore supply launder 4 to the upper surface 2*a* of the shaking table 2.

Moreover, according to the table gravity concentrator 1, additive water is successively supplied from the water supply launder 5 to the upper surface 2*a* of the shaking table 2 as illustrated in FIG. 2. More specifically, the water supply unit 23 of the water supply launder 5 supplies water to the upper surface 21*a* of the bottom unit 21 of the launder body 20 from the one end to the other end in the length direction as illustrated in FIG. 3. Then, the dispersing members 24 of the water supply launder 5 disperse the water flowing on the upper surface 21*a* of the bottom unit 21 of the launder body 20 between the front unit 22 and the dispersing members 24 such that the water disperses almost uniformly throughout the range of the bottom unit 21 in the length direction while guiding the water toward the dam 6, and drop the water from the dam 6 side upper surface 21*a* of the bottom unit 21 toward the shaking table 2. Subsequently, as illustrated in FIG. 10, the skirts 32 of the distribution member 30 of the water supply launder 5 contact the water dropped from the dam 6 side upper surface 21*a* of the bottom unit 21 of the launder body 20, and disperse the water almost uniformly while decreasing the force of the water such that the water can be uniformly supplied as additive water to the entire area of the upper surface 2*a* of the shaking table 2.

As a result, low specific gravity ore particles having low specific gravity such as gangue minerals and sulfide minerals included in the ore slurry supplied to the upper surface 2*a* of the shaking table 2 receive resistance of water flow of the additive water flowing in the width direction of the shaking table 2, and shift in the water flow direction of the additive water (width direction of the shaking table 2) while going over the riffles 3 independently from the oscillation movement of the shaking table 2 as illustrated in FIG. 2. Then, the low specific gravity ore particles drop from the front side surface 2*c* of the shaking table 2, and are recovered as tailings into the first tailing recovery storage tank 8 provided on the front side surface 2*c* side of the shaking table 2 together with the additive water.

On the other hand, high specific gravity ore particles having high specific gravity shift in the extension direction along the riffles 3 in accordance with the oscillation movement of the shaking table 2. Then, the high specific gravity ore particles flow into the flat area 12 from the tip of the riffle on the uppermost row of the midstream riffles $3a_2$ of the riffles 3, for example.

In this case, the high specific gravity ore particles flowing in the flat area 12 are more likely to shift in the water flow direction of the additive water by the flow of the additive water supplied from the water supply launder 5 when specific gravity are the same. Accordingly, the stream (gold line) 40*a* of high specific gravity, small particle diameter, and high gold grade ore particles, and a stream (tailing layer) 40*b* of high specific gravity and large particle diameter ore particles are formed in the flat area 12.

Then, the table gravity concentrator 1 separates the gold line 40*a* from the tailing layer 40*b* using the plate-shaped partition plate 7 provided on the left side surface 2*f* of the shaking table 2 in such a condition as to be movable along the left side surface 2*f*, for example. Subsequently, the table gravity concentrator 1 recovers the gold line 40*a* together with the additive water into the concentrate recovery storage tank 10 provided on the left side surface 2*f* side of the shaking table 2. Furthermore, the table gravity concentrator 1 recovers the tailing layer 40*b* together with the additive water into the second tailing recovery storage tank 9 provided on the left side surface 2*f* side of the shaking table 2.

By this method, the table gravity concentrator 1 recovers gold concentrates from gold ores containing gangue minerals or sulfide minerals.

According to the water supply launder 5 discussed herein, the distribution member 30 attached to the lower surface 21*b* of the bottom unit 21 of the launder body 20 contacts water dropping from the upper surface 21*a* of the bottom unit 21 of the launder body 20 and supplied to the shaking table 2, and disperses the water almost uniformly to balance the flow amount for each position. Accordingly, by the function of the distribution member 30, the water supply launder 5 reduces imbalance of the flow amounts of the ore slurry and the additive water on the upper surface 2*a* of the shaking table 2, and produces flow throughout the upper surface 2*a* of the shaking table 2 during concentration operation.

According to the water supply launder 5, the distribution member 30 contacts the water dropping from the upper surface 21*a* of the bottom unit 21 of the launder body 20 and supplied to the shaking table 2, and decreases the force of the water. Accordingly, the water supply launder 5 reduces imbalance of the amount of the flowing out water depending on the flow-out position, and produces flow throughout the upper surface 2*a* of the shaking table 2 even when the amount of supply water is increased.

Moreover, by the function of the distribution member 30, the water supply launder 5 reduces imbalance of the flow amounts of the ore slurry and the additive water on the upper surface 2*a* of the shaking table 2. Accordingly, the water supply launder 5 reduces disorder of the gold line 40*a*, and allows efficient concentration operation.

According to the water supply launder 5, the dispersing members 24 are provided on the upper surface 21*a* of the bottom unit 21 of the launder body 20. The dispersing members 24 uniformly disperse water supplied from the water supply unit 23 to the upper surface 21*a* of the bottom unit 21, and uniformly drop the water from the dam 6 side bottom unit 21. Thus, by the function of the dispersing members 24, the water supply launder 5 uniformly disperses water supplied from the water supply unit 23 to the upper surface 21*a* of the bottom unit 21 between the dispersing members 24 and the front unit 22 throughout the range of the bottom unit 21 in the length direction, and uniformly drops the water from the dam 6 side bottom unit 21. Accordingly, the water supply launder 5 more securely reduces imbalance of the flow amounts of the ore slurry and the additive water on the upper surface 2*a* of the shaking table 2, and more securely produces flow throughout the upper surface 2*a* of the shaking table 2 during concentration operation.

The water supply launder 5 includes the discharge unit 25 at the other end of the upper surface 21*a* of the bottom unit 21 of the launder body 20 in the length direction. The discharge unit 25 is a unit through which water supplied from the water supply unit 23 to the upper surface 21*a* of the bottom unit 21 is discharge to the outside. Thus, by the function of the discharge unit 25, the water supply launder 5 rapidly discharges water to the outside via the discharge port 26*a* by using the discharge hose 27 when water flowing through the upper surface 21*a* of the bottom unit 21 from the one end toward the other end in the length direction and colliding with the left side unit 26 reaches the discharge unit 25, and prevents the water from going over the left side unit 26 and overflowing to the outside. Moreover, by the function of the discharge unit 25, the water supply launder 5 prevents water from returning toward the one end in the length direction when the water flowing through the upper surface 21*a* of the bottom unit 21 collides with the left side unit 26. Furthermore, by the function of the discharge unit 25, the water supply launder 5 prevents a large amount of water from dropping from the dam 6 side, and going over the front unit 22 and overflowing to the outside, when the water having collided with the left side unit 26 and returned toward the one end in the length direction collides with subsequent water flowing toward the other end in the length direction. Accordingly, by the function of the discharge unit 25, the water supply launder 5 more securely reduces imbalance of the flow amounts of the ore slurry and the additive water on the upper surface 2*a* of the shaking table 2 during concentration operation, and avoids the problem that disorder of the gold line 40*a* flowing on the flat area 12 of the upper surface 2*a* of the shaking table 2 occurs as a result of overflow of water.

The water supply launder 5 includes the movable sub water supply unit 28 on the launder body 20. The sub water supply unit 28 is a unit capable of additive water supply to an arbitrary position. Thus, by the function of by the sub water supply unit 28, the water supply launder 5 supplies water to an arbitrary position of the bottom unit 21 in the length direction, and performs finer control of the flow amount of water flowing through the upper surface 21*a* of the bottom unit 21. Accordingly, by the function of the sub water supply unit 28, the water supply launder 5 more securely reduces imbalance of flow, and allows water flowing through the upper surface 21*a* of the bottom unit 21 to more uniformly drop from the dam 6 side.

Furthermore, the water supply launder 5 disposes the sub water supply unit 28 at an arbitrary position of the bottom unit 21 in the length direction to supply water. In this case, the water supply launder 5 can increase the water supply amount intentionally and partially. Accordingly, by the function of the sub water supply unit 28, the water supply launder 5 can supply additive water increased intentionally and partially to ore particles staying in an island shape on the upper surface 2*a* of the shaking table 2 for reasons of various failures, so as to eliminate the staying ore particles, for example. Therefore, by the function of the sub water supply unit 28, the water supply launder 5 reduces time and labor for eliminating the failures, and increases the operation time.

The launder body 20 and the water supply unit 23 of the water supply launder 5 are not limited to be wooden components, but may be metal or resin components.

The distribution member 30 of the water supply launder 5 is not limited to be formed by a resin plate component, but may be a string, chain, net or others. When the water dropping from the upper surface 21*a* of the bottom unit 21 of the launder body 20 and supplied to the shaking table 2 contacts a string, chain, or net attached to the lower surface 21*b* of the bottom unit 21 of the launder body 20, the water is dispersed almost uniformly such that the flow amount for each position can be balanced. In addition, the force of the flow decreases. Accordingly, the water supply launder 5 reduces imbalance of the flow amounts of the ore slurry and the additive water on the upper surface 2*a* of the shaking table 2, and produces flow throughout the upper surface 2*a* of the shaking table 2 during concentration operation, even when the distribution member 30 is constituted by a string, chain, net or others.

The table gravity concentrator 1 is not limited to a system for recovering gold concentrates from gold ores, but may be a system for recovering concentrates from other types of ores.

EXAMPLE

In the following examples, it was checked whether or not a portion forming no flow of additive water was produced on a shaking table at the time of recovery of gold concentrates from gold ores by using a table gravity concentrator. The present invention is not limited to these examples.

Example 1

In Example 1, flow of additive water on an upper surface of a shaking table was checked under the following operation conditions at the time of recovery of gold concentrates from gold ores by using a table gravity concentrator provided with a water supply launder according to the present invention.

<Operation Conditions> table gravity concentrator used: manufactured by Diester Industrie oscillation of table gravity concentrator: 150 times/minute 2.54 cm wide solid content of processed ore slurry: 20 to 40% by weight pH of processed ore slurry: neutrality (slurry containing water and ores)

processing amount of ore slurry: 155 kg/hour supply water amount: 400 kg/hour check of water amount on shaking table: Presence or absence of water flow was visually checked.

In Example 1, water flow was present throughout the upper surface of the shaking table, and the portion forming no flow was not recognized.

Comparison Example 1

In Comparison Example 1, flow of additive water on an upper surface of a shaking table was checked under the foregoing operation conditions at the time of recovery of gold concentrates from gold ores similarly to Example 1, but by using a table gravity concentrator provided with a conventional water supply launder not including a distribution member instead of the water supply launder according to the present invention.

In Comparison Example 1, the portion forming no flow was recognized on a part of the upper surface of the shaking table.

REFERENCE SIGNS LIST

1 table gravity concentrator
2 shaking table
2*a* upper surface
2*b* lower surface
2*c* front side surface
2*d* rear side surface
2*e* right side surface
2*f* left side surface
3 riffle
4 ore supply launder

5 water supply launder
6 dam
7 partition plate
8 first tailing recovery storage tank
9 second tailing recovery storage tank
10 concentrate recovery storage tank
11 oscillation driving mechanism
12 flat area
20 launder body
21 bottom unit
21*a* upper surface
21*b* lower surface
22 front unit
23 water supply unit
23*a* water supply hose
23*b* opening
24 dispersing member
25 discharge unit
26 left side unit
26*a* discharge port
27 discharge hose
28 sub water supply unit
28*a* sub water supply hose
30 distribution member
31 body
32 skirt
32 triangular skirts
33 staplers
40*a* gold line
40*b* tailing layer
102 shaking table
102*c* front side surface
103 riffle
104 ore supply launder
105 water supply launder
107 partition plate
108 first tailing recovery storage tank
109 second tailing recovery storage tank
110 concentrate recovery storage tank
111 oscillation driving mechanism
112 flat area
140*a* gold line
140*b* tailing layer

What is claimed is:

1. A water supply launder included in a table gravity concentrator to supply water to a table of the table gravity concentrator, comprising:

a launder body that receives water supplied from a water supply unit to an upper surface of the launder body and supplies the water to the table of the table gravity concentrator; and a distribution member that is attached to a lower surface of the launder body and contacts water dropping from the upper surface of the launder body and flowing to the table of the table gravity concentrator to distribute the water, wherein the distribution member comprises a plurality of skirts disposed on a body of the distribution member and forming a serrate shape, and wherein a length L of each of the skirts of the distribution member is determined such that a relation $0.3\ H \leq L \leq 0.5\ H$ holds when a distance between the lower surface of the launder body and an upper surface of the table is H.

2. The water supply launder of the table gravity concentrator according to claim 1, wherein a discharge unit is provided at an end of the launder body on a side opposite to the water supply unit.

3. The water supply launder of the table gravity concentrator according to claim 1, wherein a movable sub water supply unit that supplies additive water to an arbitrary position is provided on the launder body.

4. The water supply launder of the table gravity concentrator according to claim 1, wherein a dispersing member is provided on the upper surface of the launder body, the dispersing member uniformly dispersing water supplied from the water supply unit to the upper surface and dropping the water from the upper surface of the launder body.

5. A water supply launder included in a table gravity concentrator to supply water to a table of the table gravity concentrator, comprising:

a launder body that receives water supplied from a water supply unit to an upper surface of the launder body and supplies the water to the table of the table gravity concentrator; and a distribution member that is attached to a lower surface of the launder body and contacts water dropping from the upper surface of the launder body and flowing to the table of the table gravity concentrator to distribute the water, wherein the distribution member comprises a plurality of skirts disposed on a body of the distribution member and forming a serrate shape, and wherein a width of each of the skirts of the distribution member is 0.5 L when a length of each of the skirts of the distribution member is L.

6. The water supply launder of the table gravity concentrator according to claim 5, wherein a discharge unit is provided at an end of the launder body on a side opposite to the water supply unit.

7. The water supply launder of the table gravity concentrator according to claim 5, wherein a movable sub water supply unit that supplies additive water to an arbitrary position is provided on the launder body.

8. The water supply launder of the table gravity concentrator according to claim 5, wherein a dispersing member is provided on the upper surface of the launder body, the dispersing member uniformly dispersing water supplied from the water supply unit to the upper surface and dropping the water from the upper surface of the launder body.

* * * * *